US011028732B2

(12) United States Patent
McGivern et al.

(10) Patent No.: US 11,028,732 B2
(45) Date of Patent: Jun. 8, 2021

(54) HIGH TEMPERATURE PANEL DAMPER FOR SHEET METAL STRUCTURES

(71) Applicant: Rolls-Royce North American Technologies Inc., Indianapolis, IN (US)

(72) Inventors: William McGivern, Indianapolis, IN (US); Michel S. Smallwood, Greenwood, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 36 days.

(21) Appl. No.: 16/561,782

(22) Filed: Sep. 5, 2019

(65) Prior Publication Data

US 2021/0071547 A1 Mar. 11, 2021

(51) Int. Cl.
*F01D 25/30* (2006.01)
*F01D 25/04* (2006.01)

(52) U.S. Cl.
CPC ..... *F01D 25/30* (2013.01); *F01D 25/04* (2013.01); *F05D 2260/31* (2013.01); *F05D 2260/96* (2013.01)

(58) Field of Classification Search
CPC ..... F01D 25/04; F01D 25/30; F01D 2260/31; F01D 2260/96; F05D 2260/96; F24F 13/24; F24F 2013/242; F24F 2013/245; F24F 2013/247; F02C 7/24; F02K 1/827
See application file for complete search history.

(56) References Cited

U.S. PATENT DOCUMENTS 3,020,986 A 8/1958 Kirk et al.
3,019,850 A * 2/1962 March ..... F16L 55/02754 181/224
3,071,217 A 1/1963 Gould
3,511,336 A * 5/1970 Rink ..... F04D 29/664 181/224
4,137,992 A * 2/1979 Herman ..... F02K 1/827 181/213
4,453,887 A * 6/1984 Schucker ..... F03B 3/04 415/119
4,645,032 A * 2/1987 Ross ..... F02C 7/24 181/224
5,594,216 A * 1/1997 Yasukawa ..... F02C 7/045 181/213
6,266,427 B1 7/2001 Mathur
6,571,910 B2 * 6/2003 Storm ..... F01N 1/04 181/249
7,919,174 B2 4/2011 Ruokolainen et al.
8,459,407 B2 * 6/2013 Jangili ..... F24F 13/24 181/224
8,479,876 B2 7/2013 Fetsko et al.
8,640,825 B2 2/2014 Vauchel et al.
(Continued)

*Primary Examiner* — Jesse S Bogue
(74) *Attorney, Agent, or Firm* — Barnes & Thornburg LLP

(57) ABSTRACT

An exhaust assembly for use with a gas turbine engine includes an exhaust duct and a damper system coupled to the exhaust duct. The exhaust duct is configured for fluid communication with the gas turbine engine to receive hot exhaust gases produced by the gas turbine engine. The exhaust duct includes a plurality of panels that define an exhaust passageway. The damper system is coupled to one of the plurality of panels and is configured to dampen vibration of the exhaust duct during use of the gas turbine engine.

17 Claims, 5 Drawing Sheets

(56) References Cited

U.S. PATENT DOCUMENTS

| | | | | |
|---|---|---|---|---|
| 9,511,571 | B2 | 12/2016 | Montgomery et al. | |
| 9,783,316 | B2 * | 10/2017 | Alonso-Miralles .... | B64D 33/06 |
| 2007/0284185 | A1 | 12/2007 | Foss | |
| 2017/0080681 | A1 | 3/2017 | Montgomery et al. | |
| 2018/0043982 | A1 | 2/2018 | Fink et al. | |

* cited by examiner

HIGH TEMPERATURE PANEL DAMPER FOR SHEET METAL STRUCTURES

FIELD OF THE DISCLOSURE

The present disclosure relates generally to high temperature exhaust systems and particularly to dampers used with high temperature exhaust systems. More particularly, the present disclosure relates to exhaust ducts and damper systems for use with gas turbine engines.

BACKGROUND

Gas turbine engines and other engines typically combust fuel during operation. The combustion process produces hot exhaust gases which may be directed away from the gas turbine engine through one or more exhaust ducts. The exhaust gases may cause the exhaust duct to vibrate and produce noises. Some exhaust ducts may include stiffening structures to strengthen the exhaust duct to reduce vibrations and noise. However, these features may use time and costs to design the exhaust duct as well as added materials.

SUMMARY

The present disclosure may comprise one or more of the following features and combinations thereof.

According to one aspect of the present disclosure, an exhaust assembly for use with a gas turbine engine includes an exhaust duct, and a damper system. The exhaust duct is configured for fluid communication with the gas turbine engine to receive hot exhaust gases produced by the gas turbine engine. a damper system configured to dampen vibration of the exhaust duct during use of the gas turbine engine.

In some embodiments, the exhaust duct includes a plurality of panels that define an exhaust passageway. A first panel included in the plurality of panels includes a flat inner surface that faces toward the exhaust passageway, a flat outer surface opposite the flat inner surface, and an outer edge that extends around the first panel. The first panel is supported only along the outer edge.

In some embodiments, the damper system includes a fabric damper sheet, a rigid damper plate, and a damper bracket. The fabric damper sheet is engaged with the flat outer surface of the first panel. The rigid damper plate is arranged in face-to-face relation with the fabric damper sheet and spaced apart from the first panel to locate the fabric damper sheet between the damper plate and the first panel. The damper plate has a body and a perimeter edge arranged around the body.

In some embodiments, the damper bracket has a frame that extends along the perimeter edge of the damper plate and defines a window that opens through the damper bracket to expose the body of the damper plate. The damper bracket is coupled with the first panel and engaged with the perimeter edge of the damper plate to change a resonance frequency of the exhaust duct and dampen the vibration of the exhaust duct during use of the gas turbine engine.

In some embodiments, the damper plate is coupled to the damper bracket by friction only. In some embodiments, the fabric damper sheet comprises non-viscoelastic material.

In some embodiments, the frame of the damper bracket includes an attachment segment with an inner surface coupled to the first panel and a clip segment with an inner surface engaged with the damper plate. The clip segment is offset from the attachment segment and arranged generally parallel with the attachment segment.

In some embodiments, the clip segment is spaced apart from the damper plate to define a damper cavity between the clip segment and the first panel. A distance from the inner surface of the clip segment to the first panel is less than a cumulative thickness of the damper plate and the fabric damper sheet.

In some embodiments, the frame further includes a link that extends outwardly away from the first panel at an angle relative to the first panel to interconnect the attachment segment and the clip segment.

In some embodiments, the frame of the damper bracket includes an attachment segment with an inner surface coupled to the first panel, a clip segment with an inner surface engaged with the damper plate, and a link that extends outwardly away from the first panel at an angle relative to the first panel to interconnect the attachment segment to the clip segment. The clip segment extends downwardly from the link at an angle toward the damper plate and is configured to apply a compressive force on the damper plate when the frame is fully installed on the first panel.

In some embodiments, the damper bracket further includes a cross member that extends across the window of the frame to divide the window into a first aperture and a second aperture. The damper bracket may further include a stiffening rib coupled with the cross member to reinforce the cross member and the frame.

According to another aspect of the present disclosure, the damper system includes a damper, a damper plate, and a damper bracket. The damper may be coupled with the flat outer surface of the first panel. The damper plate is arranged in face-to-face relation with the damper and spaced apart from the first panel to locate the damper between the damper plate and the first panel. The damper plate has a body and a perimeter edge arranged around the body. The damper bracket is coupled with the first panel and engaged with the damper plate to change a resonance frequency of the exhaust duct and dampen the vibration of the exhaust duct during use of the gas turbine engine.

In some embodiments, the damper includes a fabric damper sheet made from non-viscoelastic material positioned between the damper plate and the first panel.

In some embodiments, an air gap is defined between the damper plate and the first panel to provide the damper.

In some embodiments, the damper bracket includes a plurality of washers coupled with an outer surface of the damper plate and a plurality of fasteners that extend through apertures formed in the damper plate and the first panel, the plurality of washers configured to clamp the damper plate and the damper between the plurality of washers and the first panel.

According to another aspect of the present disclosure, a method includes: providing an exhaust duct formed from a plurality of panels with inner surfaces defining an exhaust passageway and outer surfaces facing away from the exhaust passageway; discharging exhaust gases through the exhaust passageway to cause at least one of the panels to vibrate and produce noise and to expose the at least one panel to temperatures greater than about 250 degrees Fahrenheit; and changing a resonance frequency of the at least one panel by coupling a fabric damper sheet to the outer surface of the at least one panel to reduce vibrations and noise.

In some embodiments, the step of changing the resonance frequency of the at least one panel includes applying a rigid damper plate over the fabric damper sheet to locate the fabric damper sheet between the damper plate and the at least one panel.

In some embodiments, the step of changing a resonance frequency of the at least one panel further includes clamping the damper plate and the fabric damper sheet to the at least one panel with a damper bracket that has a frame disposed around a perimeter of the damper plate and defines a window that opens to expose the damper plate.

In some embodiments, the step of changing a resonance frequency of the at least one panel further includes clamping the damper plate and the fabric damper sheet to the at least one panel with a plurality of washers and corresponding fasteners, the plurality of washers disposed along an outer surface of the damper plate.

These and other features of the present disclosure will become more apparent from the following description of the illustrative embodiments.

DETAILED DESCRIPTION OF THE DRAWINGS

Figure 1:
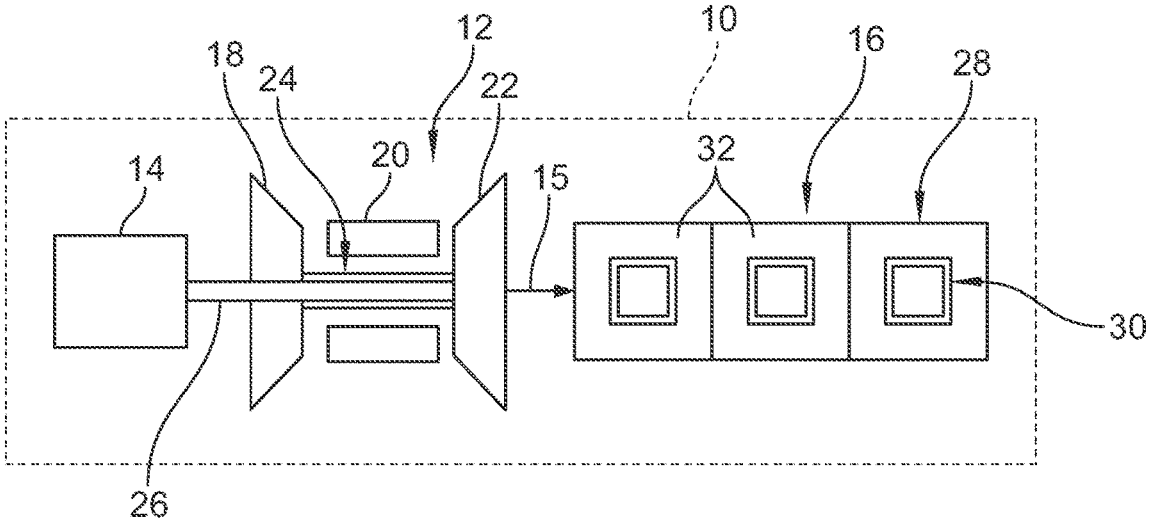
FIG. 1 is a diagrammatic view of a power generation facility including a gas turbine engine, a generator, and an exhaust assembly, and showing that the exhaust assembly includes an exhaust duct provided by a plurality of panels and a damper system coupled to the panels and configured to change a resonance frequency of the exhaust duct and dampen vibration of the exhaust duct during use of the gas turbine engine.

For the purposes of promoting an understanding of the principles of the disclosure, reference will now be made to a number of illustrative embodiments illustrated in the drawings and specific language will be used to describe the same.

In accordance with the present disclosure, a power generation facility 10 includes an engine 12, a generator 14, and an exhaust assembly 16 coupled with the engine 12 as shown in FIG. 1. The engine 12 is configured to combust fuel and air to drive rotation of the generator 14. When driven by the engine 12, the generator 14 produces electricity that can be used to power various devices. Combustion of the fuel and air in the engine 12 produces hot exhaust gases that are discharged from the engine 12 into the exhaust assembly 16. The exhaust assembly 16 is configured to carry the exhaust gases away from the gas turbine engine 12 and discharge the exhaust gases into the atmosphere.

In the illustrative embodiment, the engine 12 includes a gas turbine engine; however in other embodiments any combustion engine may be used. The gas turbine engine is shown diagrammatically in FIG. 1 and includes a compressor section 18, a combustor section 20, and a turbine section 22. The compressor section 18 is configured to pressurize air and delivers the pressurized air to the combustor section 20. Fuel is injected in to the combustor section 20 and ignited with the pressurized air to produce hot, high pressure gases which are discharged from the combustor section 20 toward the turbine section 22. The hot, high pressure gases drive rotation of rotating components (i.e. blades and disks) in the turbine section 22. The compressor section 18 and the turbine section 22 are interconnected by one or more shafts 24. At least one of the shafts coupled to the turbine section 22, in this case, a low pressure shaft 26, is coupled with the generator and is configured to drive rotation of parts of the generator 14 to produce electricity.

Figure 2:
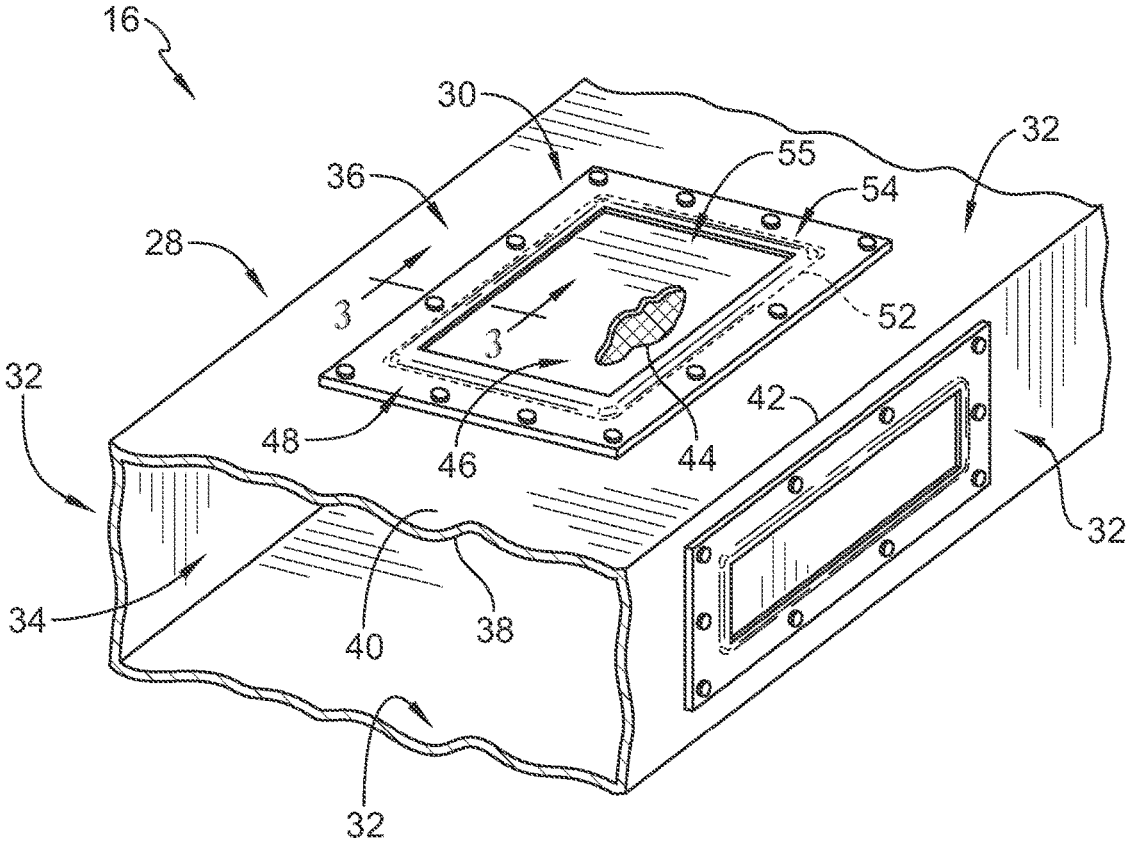
FIG. 2 is a perspective view of a portion of the exhaust assembly from FIG. 1 showing that the damper system includes a damper plate and a damper bracket with a frame that defines a window that opens through the damper bracket to expose the body of the damper plate and a portion of the damper plate cutaway to reveal a damper sheet.

The exhaust assembly 16 includes an exhaust duct 28 and a damper system 30 coupled to the exhaust duct 28 and configured to dampen vibration of the exhaust duct 28 during use of the gas turbine engine 12 as shown in FIGS. 1 and 2. The exhaust duct 28 is arranged in fluid communication with the gas turbine engine 12 and receives the hot exhaust gases produced by the gas turbine engine 12.

The exhaust duct 28 includes a plurality of panels 32 that define an exhaust passageway 34. Each of the plurality of panels 32 is made from sheet metal and may vibrate and produce noise as the hot exhaust gases flow through the exhaust passageway 34. The plurality of panels 32 may be integrally formed or formed from independent panel sections that are coupled together via fasteners, welding, brazing, etc. The damper system 30 is coupled to at least one of the panels 32 as shown in FIGS. 1 and 2.

A first panel 36 included in the plurality of panels 32 includes a flat inner surface 38 that faces toward the exhaust passageway 34, a flat outer surface 40 opposite the flat inner surface 38, and an outer edge 42 that extends around the first panel 36 as shown in FIG. 2. In the illustrative embodiment, the first panel 36 is supported only along its outer edge 42 relative to the rest of the exhaust duct 28. Collectively, each panel 32 supports one another at their edges to provide a generally rectangular conduit that defines the exhaust passageway 34.

The plurality of panels 32 are unsupported along their inner surfaces and outer surfaces. In other words, the panels 32 like a simply supported beam; the panels 32 are supported at their edges, but are not supported in their midsections (by struts or any other support feature). Other panels that are used to form exhaust ducts are designed with structures that reinforce each panels to reduce vibrations and noise. The panels in the illustrative embodiment are formed without any reinforcement structures to reduce an amount of material used to construct the exhaust duct 28 and minimize time and cost that would ordinarily be spent designing each of the panels 32 in a way which reinforces the panels 32.

Vibrations and noise are reduced in the illustrative embodiment by providing the damper system 30 on one or more of the panels 32 as shown in FIGS. 1 and 2. The damper system 30 includes a fabric damper sheet 44, a rigid damper plate 46, and a damper bracket 48. The fabric damper sheet 44 is engaged with the flat outer surface 40 of the first panel 36. The rigid damper plate 46 is arranged in face-to-face relation with the fabric damper sheet 44. The rigid damper plate 46 is spaced apart from the first panel 36 to locate the fabric damper sheet 44 between the rigid damper plate 46 and the first panel 36. The damper bracket 48 is coupled with the first panel 36 and is configured to retain the damper plate 46 in engagement with the fabric damper sheet 44 so that the fabric damper sheet 44 and the rigid damper plate 46 provide a friction damper.

The fabric damper sheet 44 is made from a material that is able to withstand high temperatures caused by the hot exhaust gases flowing through the exhaust passageway 34. Some friction dampers include a viscoelastic material, such as rubber, for example, which fail when exposed to elevated temperatures (i.e. greater than 250 degrees Fahrenheit). In the illustrative embodiment, the fabric damper sheet 44 is made from only non-viscoelastic materials and is capable of withstanding temperatures greater than at least 250 degrees Fahrenheit. One non-limiting example of a suitable sheet is NEXTEL™ produced by 3M Manufacturing Company; however any suitable non-viscoelastic material may be used.

Figure 3:
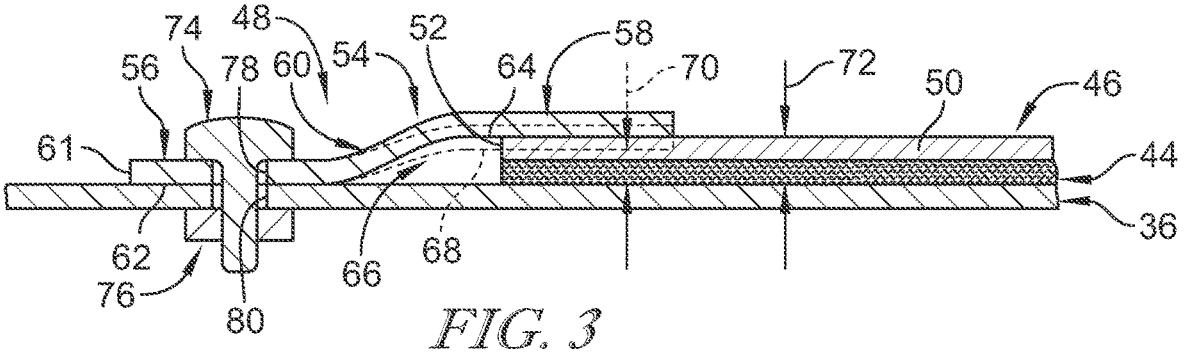
FIG. 3 is a cross sectional view taken along line 3-3 of FIG. 2 showing that the damper system further includes the fabric damper sheet engaged with one of the panels of the exhaust duct between the damper plate and the exhaust duct and the damper bracket includes an attachment segment mounted to the panel and a clip segment engaged with the damper plate and configured to apply a compressive force on the damper plate to increase friction between the fabric damper sheet and the panel.

The damper plate 46 includes a body 50 and a perimeter edge 52 arranged around the body 50 as shown in FIGS. 2 and 3. The body 50 is substantially flat in the illustrative embodiment. The perimeter edge 52 provides the damper plate 46 with length and width dimensions that are about equal to length and width dimensions of the fabric damper sheet 44. In other embodiments, the damper plate 46 may have dimensions that are larger than or smaller than the dimensions of the fabric damper sheet.

The damper bracket 48 includes a frame 54 that at least partially extends along the perimeter edge 52 of the damper plate 46 and retention means for coupling the damper plate 46 to the first panel 36 as shown in FIGS. 2 and 3. The frame 54 defines a window 55 that opens through the damper bracket 48 to expose the body 50 of the damper plate 46 when the damper system 30 is fully installed on the first panel 36. The damper bracket 48 is configured to retain the damper plate 46 and the fabric damper sheet 44 in contact with the flat outer surface 40 of the first panel 36 to change a resonance frequency of the exhaust duct 28 and dampen the vibration of the exhaust duct 28 during use of the gas turbine engine. Damping vibrations increases a useful life of the exhaust duct 28 and reduces noise produced by the vibrations.

The frame 54 of the damper bracket 48 is configured to provide a force on the damper plate 46 that increases a coefficient of friction of the fabric damper sheet 44 relative to the outer surface 40 of the first panel 36. The frame 54 includes an attachment segment 56, a clip segment 58, and a link 60 interconnecting the attachment segment 56 and the clip segment 58 as shown in FIG. 3. The attachment segment 56 has an inner surface 62 coupled to the first panel 36 while the clip segment 58 has an inner surface 64 engaged with the damper plate 46. The clip segment is located inwardly from the attachment segment 56 relative to an outer perimeter 61 of the frame 54 and is coupled to the damper plate 46 by friction only. The link 60 extends outwardly away from the first panel 36 at an angle relative to the first panel 36 to interconnect the attachment segment 56 and the clip segment 58.

The clip segment 58 is offset from the attachment segment 56 relative to the first panel 36 and arranged generally parallel with the attachment segment 56. The clip segment 58 is spaced apart from the damper plate 46 to define a damper cavity 66 between the clip segment 58 and the first panel 36. Prior to installation, the clip segment 58 of the frame 54 may be arranged at a position 68 indicated by the dashed lines in FIG. 3. At position 68, a distance 70 from the inner surface 64 of the clip segment 58 to the outer surface 40 of the first panel 36 is less than a cumulative thickness 72 of the damper plate 46 and the fabric damper sheet 44.

When the damper bracket 48 is installed, the clip segment 58 engages the damper plate 46 and flexes upwardly relative to the attachment segment 56 due to the size differences between distance 70 and thickness 72. In the flexed position, the clip segment 58 provides a compressive force on the damper plate 46 to increase a coefficient of friction between the damper plate 46 and the fabric damper sheet 44 and between the fabric damper sheet 44 and the first panel 36.

The retention means in the illustrative embodiment includes a fastener 74 and a nut 76 as shown in FIG. 3. The fastener 74 extends through apertures 78, 80 formed in the attachment segment 56 and the first panel 36, respectively. The nut 76 coupled with the fastener 74 from inside the exhaust passageway 34 and, when tightened relative to the fastener, mounts the attachment segment 56 to the first panel 36 to cause the clip segment to flex and apply the compressive force on the damper plate 46.

Figure 4:
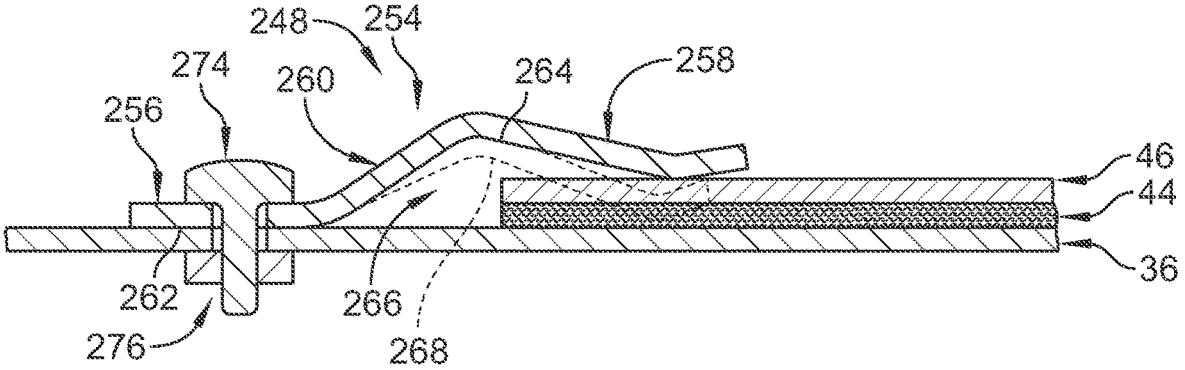
FIG. 4 is a cross sectional view similar to FIG. 3 of another damper bracket showing that the damper bracket includes an attachment segment and a clip segment arranged at an angle relative to the attachment segment and the panel and suggesting that clip segment flexes as the damper plate is installed on the exhaust duct to apply a compressive force on the damper bracket.

Another embodiment of a damper bracket 248 is shown in FIG. 4. The damper bracket 248 is similar to damper bracket 48 and is described below using similar reference numbers in the 200 series. The disclosure for damper bracket 48 is incorporated herein for damper bracket 248 except for the differences described below.

The damper bracket 248 includes a frame 254 and retention means as shown in FIG. 4. The frame 254 of the damper bracket 248 includes an attachment segment 256, a clip segment 258, and a link 260. The attachment segment 256 has an inner surface 262 coupled to the first panel 36. The clip segment 258 has an inner surface 264 engaged with the damper plate 46. The link 260 extends outwardly away from the first panel 36 at an angle relative to the first panel 36 to interconnect the attachment segment 256 to the clip segment 258.

The clip segment 258 extends downwardly from the link 260 at an angle relative to the first panel toward the damper plate 46 as shown in FIG. 4. Prior to installation, the clip segment 258 of the frame 254 may be arranged at a position 268 indicated by the dashed lines in FIG. 4. When the frame 254 is fully installed, the clip segment 258 flexes upwardly and is configured to apply a compressive force on the damper plate 46. The angle of the clip segment 258 relative to the first panel 36 allows the frame 254 to exert a higher compressive force on the damper plate 46.

Figure 5:
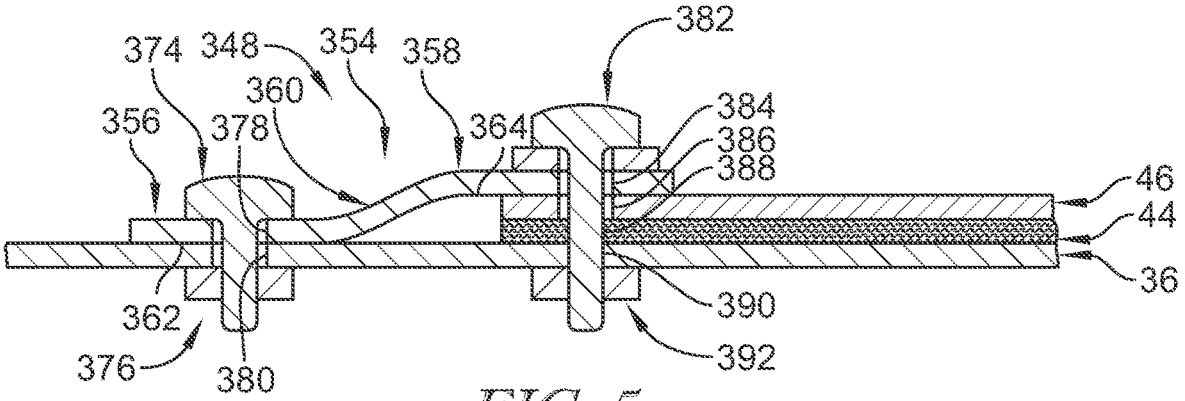
FIG. 5 is a cross sectional view similar to FIG. 3 of another damper bracket showing that the damper bracket includes an attachment segment and a clip segment and fasteners extend through both the attachment segment and the clip segment to mount the damper system to the exhaust duct.

Another embodiment of a damper bracket 348 is shown in FIG. 5. The damper bracket 348 is similar to damper bracket 48 and is described below using similar reference numbers in the 300 series. The disclosure for damper bracket 48 is incorporated herein for damper bracket 348 except for the differences described below.

The damper bracket 348 includes a frame 354 and retention means as shown in FIG. 5. The frame 354 of the damper bracket 348 includes an attachment segment 356, a clip segment 358, and a link 360. The attachment segment 356 has an inner surface 362 coupled to the first panel 36. The clip segment 358 has an inner surface 364 engaged with the damper plate 46. The link 360 extends outwardly away from the first panel 36 at an angle relative to the first panel 36 to interconnect the attachment segment 356 to the clip segment 358.

The retention means in the illustrative embodiment includes a first fastener 374 and a second fastener 382 as shown in FIG. 3. The first fastener 374 extends through apertures 378, 380 formed in the attachment segment 356 and the first panel 36, respectively. A nut 376 couples with the first fastener 374 from inside the exhaust passageway 34 and, when tightened relative to the fastener, mounts the attachment segment 356 to the first panel 36. The second fastener 382 extends through apertures 384, 386, 388, and 390 formed, from top to bottom, though the clip segment 358, the damper plate 46, the fabric damper sheet 44 and the first panel 36. A nut 392 couples with the second fastener 382 from inside the exhaust passageway 34 and, when tightened relative to the fastener, mounts the clip segment 358 to the first panel 36. The damper plate 46 and the fabric damper sheet 44 are clamped by the tightening of the nut 392 with the second fastener 382.

Figure 6:
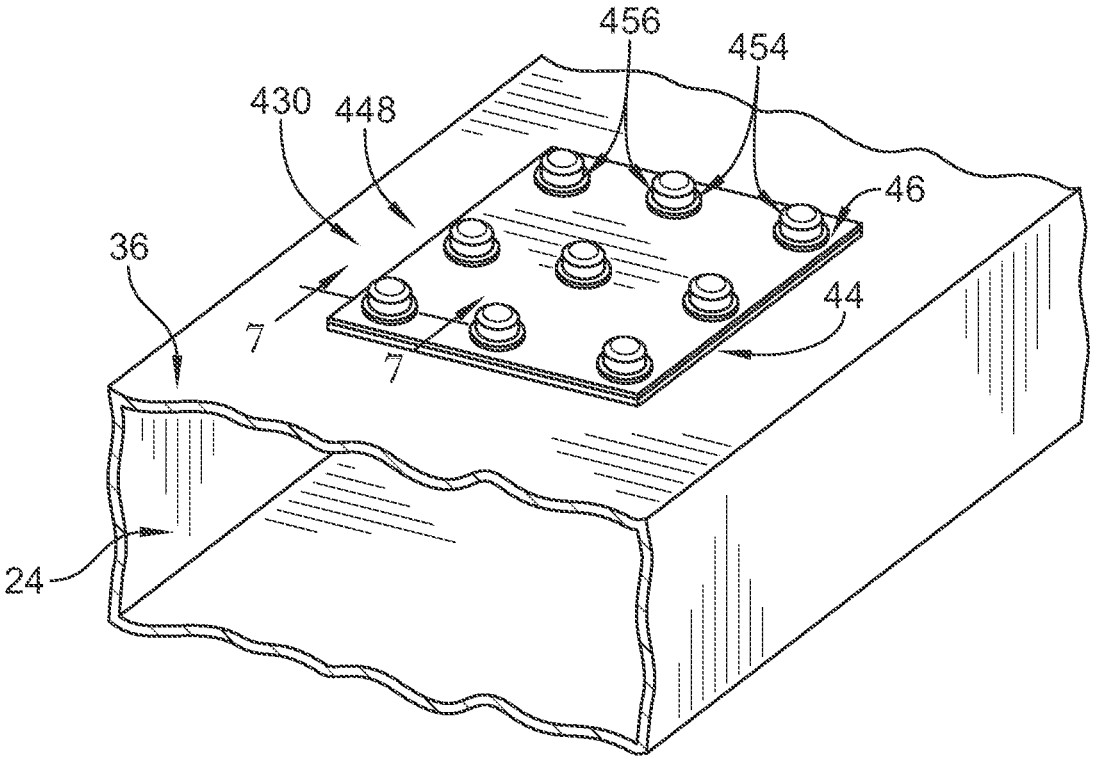
FIG. 6 is a partial perspective view of the exhaust duct of FIG. 1 showing the exhaust duct and another damper system having a damper bracket, the damper bracket including a plurality of washers disposed on an outer surface of the damper plate and configured to receive fasteners that extend through the damper plate and the exhaust duct to mount the damper system to the exhaust duct.
Figure 7:
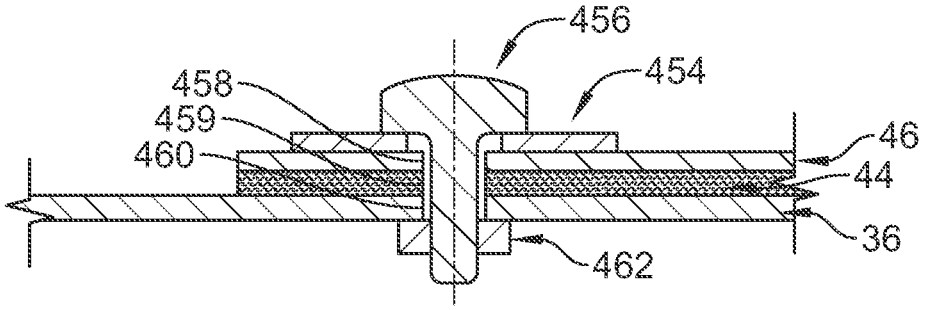
FIG. 7 is cross sectional view taken through one of the washers shown in FIG. 6 showing that the plurality of washers include fender washers.

Another embodiment of a damper system 430 is shown in FIGS. 6 and 7. The damper system 430 is similar to damper system 30 and includes the fabric damper sheet 44, the rigid damper plate 46 and a damper bracket 448 as shown in FIG. 6. The damper bracket 448 includes a plurality of washers 454 coupled with an outer surface of the damper plate 46 and a plurality of fasteners 456. The plurality of washers 454 are spaced apart from one another across the damper plate 46. The plurality of washers 454 may be arranged only along the perimeter 52 of the damper plate 46, or, alternatively, additional washers 454 may be provided inward from the perimeter 52 in the body 50 of the damper plate 46.

Figure 8:
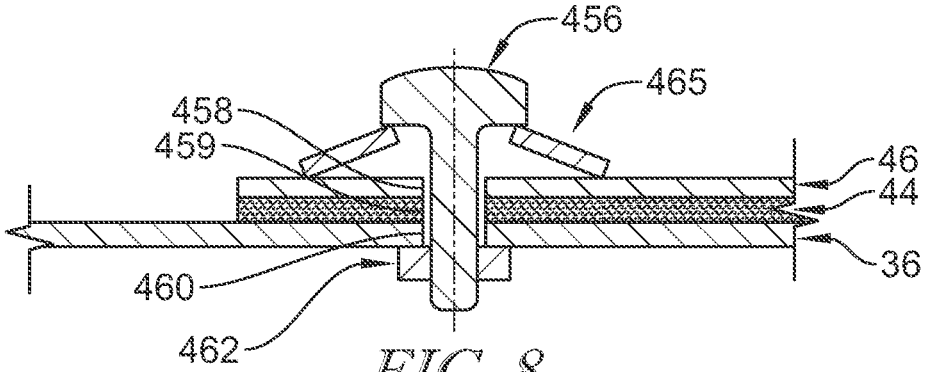
FIG. 8 is a cross sectional view similar to FIG. 7 showing a fifth embodiment of a damper bracket that includes a plurality of conical spring washers.

Each of the fasteners 456 extend through apertures 458, 459, 460 formed in the damper plate 46, the fabric damper sheet 44, and the first panel 36, respectively, as shown in FIG. 7. The plurality of fasteners 456 are configured to clamp the plurality of washers 454 to the damper plate 46 when each fastener 456 is mounted to the first panel 36 by corresponding nuts 462 and tightened. Each of the plurality of washers 454 shown in FIGS. 6 and 7 are fender washers. In another embodiment, each of the plurality of washers includes a conical spring washers 465 as shown in FIG. 8. The conical spring washers 465 (also called Belleville washers) are configured to apply a tuneable compressive force on the damper plate than the fender washers shown in FIGS. 6 and 7.

Figure 9:
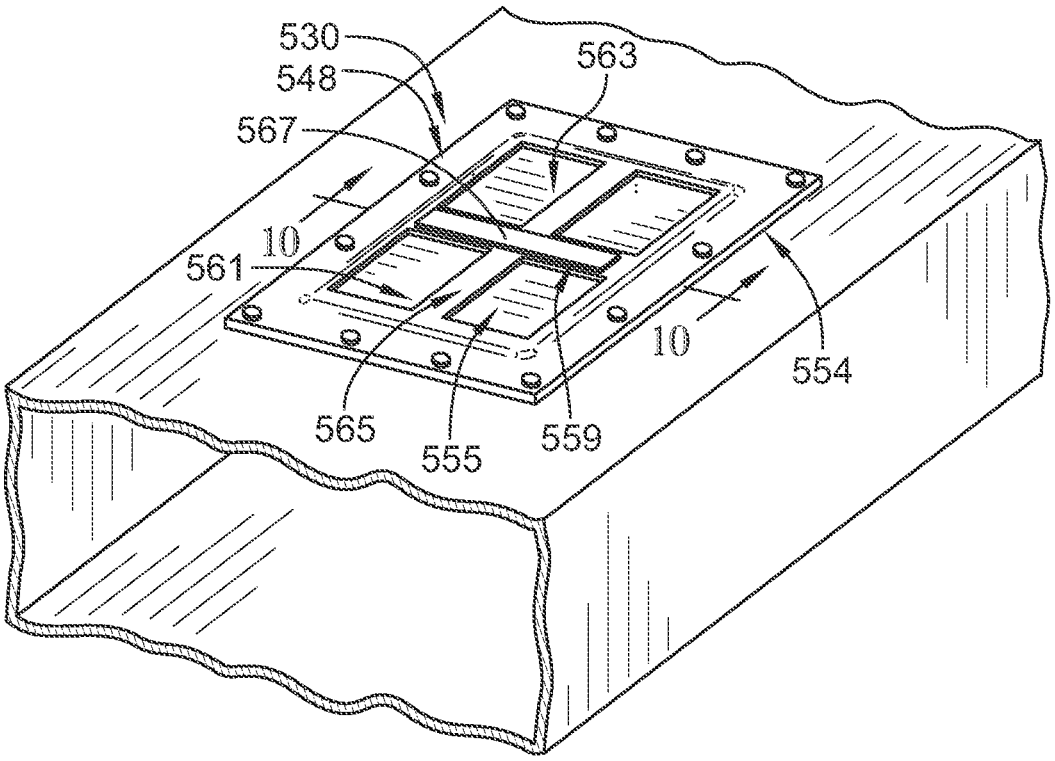
FIG. 9 is a perspective view of the exhaust duct of FIG. 1 having a damper system with a damper bracket, the damper bracket including a frame that extends around a perimeter of the damper plate and defines a window, a cross member that extends across the window of the frame to divide the window into a first aperture and a second aperture, and a stiffening rib coupled with the cross member to reinforce the cross member and the frame.
Figure 10:
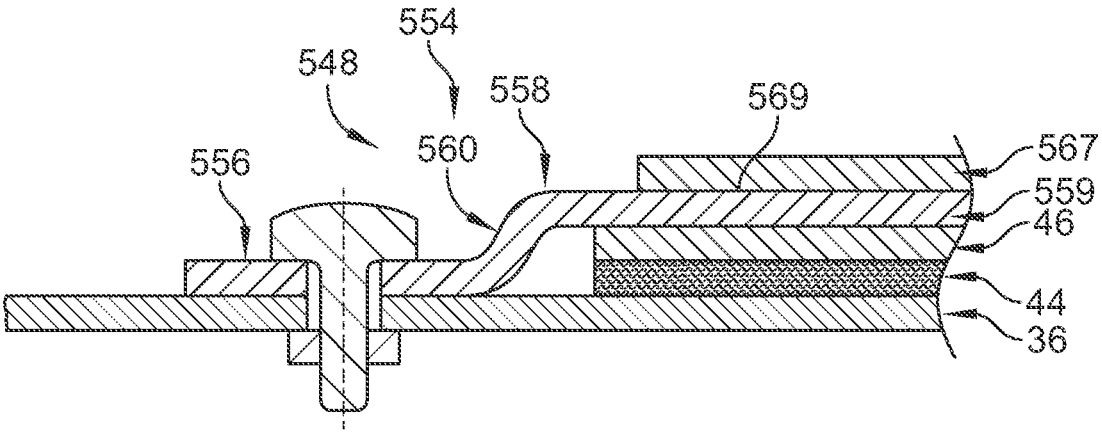
FIG. 10 is a cross sectional view of the damper system shown in FIG. 9 showing the cross member and the stiffening rib extending across the outer surface of the damper plate to reinforce the damper plate.

Another embodiment of a damper system 530 is shown in FIGS. 9 and 10. The damper system 530 is similar to damper system 30 and includes the fabric damper sheet 44, the rigid damper plate 46, and a damper bracket 548. The damper bracket 548 includes a frame 554 with an attachment segment 556, a clip segment 558, a link 560 interconnecting the attachment segment 556 and the clip segment 558, and at least one cross member 559.

The frame 554 is formed to include a window 555. The cross member 559 extends across the window 555 of the frame 554 and divides the window 555 into a first aperture 561 and a second aperture 563. The cross member 559 is configured to reinforce the frame 554 and provide more support for the damper plate 46. In the illustrative embodiment, the damper bracket 548 further includes a second cross member 565 arranged perpendicular to the cross member 559. The cross member 559 and the second cross member 565 cooperate with the frame to divide the window 555 into four apertures.

In the illustrative embodiment, the damper bracket 548 may further include a stiffening rib 567 coupled with an outer surface 569 of one or both of the cross members 559, 565. The stiffening rib 567 is configured to reinforce the cross member 559 which further reinforces the frame 554 and provides more support for the damper plate 46. In illustrative embodiments, the stiffening rib 567 is integral with the damper bracket 548 such that they form a single unitary component. The sheet metal of the damper bracket 548 maybe bent or formed to provide the stiffening rib 567.

Figure 11:
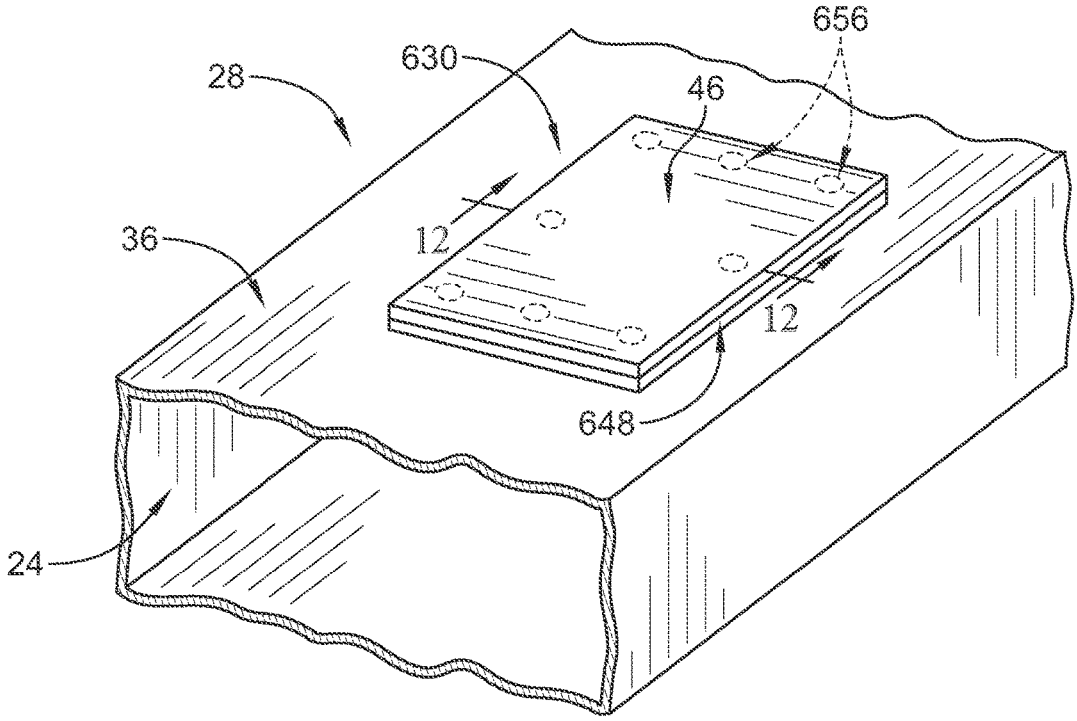
FIG. 11 is a perspective view similar to FIGS. 2, 6, and 9 showing the exhaust duct and another embodiment of a damper system that includes a damper plate and a damper bracket engaged with the damper plate.
Figure 12:
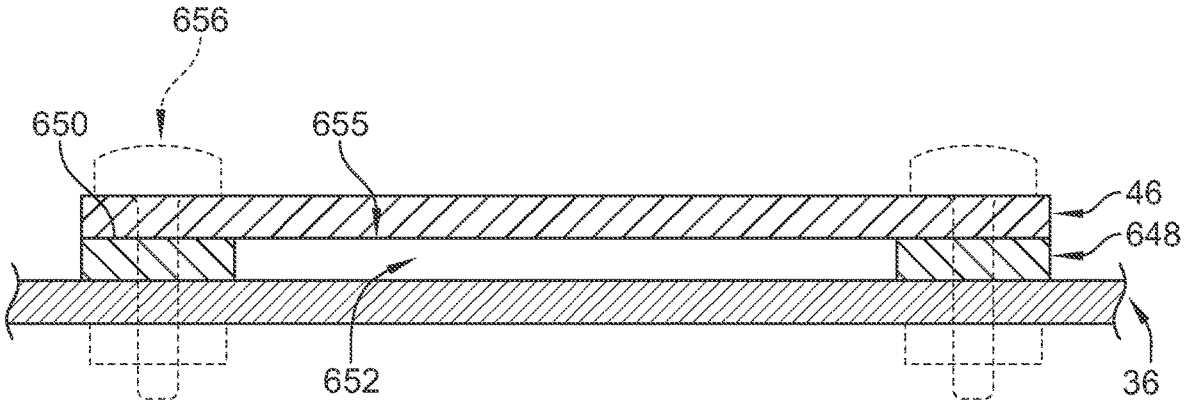
FIG. 12 is a cross sectional view of the exhaust duct and the damper system in FIG. 11 showing that an air gap is provided between the damper plate and the exhaust dust to provide a damper that reduces vibrations of the exhaust duct.

Another embodiment of a damper system 630 is shown in FIGS. 11 and 12. The damper system 630 includes the damper plate 46 and a damper bracket 648 configured to mount the damper plate 46 to the first panel 36. The damper bracket 648 is coupled directly to the first panel 36 and is formed to include a window 655. The damper plate 46 is coupled to an outer surface 650 of the damper bracket 648 to arrange the damper plate 46 in spaced apart relation to the first panel 36 and provide an air gap 652 between the damper plate 46 and the first panel 36 in the window 655. The air gap 652 provides a damper for the first panel 36. The damper plate 46 and the damper bracket 648 may be mounted to the first panel 36 by a plurality of fasteners 656 or another suitable fastening means.

In some embodiments, large panels exposed to aero-acoustic excitation may exhibit damaging resonance at one or more frequencies experienced within the component's operating envelope. In the past, if these damaging resonances were predicted or experienced during testing, the natural tendency of a designer was to add stiffening features to the component panels for purposes of driving the damaging resonance outside of the operating envelope.

In some embodiments, the ability to redesign the system to include stiffening features may not be an option. Typical viscoelastic dampening sheets may not be a viable option given there limited temperature capability. The damper system in accordance with the present disclosure may reduce damaging resonance of the ejector panels at elevated temperatures. The damper system may be installed in several locations on unsupported panels on an exhaust ejector, or duct. The damper system may also be used on any large unsupported panel exposed to aero-acoustic excitation.

In some embodiments, plates may be placed on the large unsupported panels within an ejector or duct. These plates may or may not trap a high temperature fabric layer (e.g. NEXTEL™ cloth) between the plate and the unsupported panel. The plates are held in place with a picture frame like structure which may or may not impose a preload on the plate/fabric layer utilizing fender and/or Bellville washers. The combination of these components results in a frictional damper whereby friction is created between the fabric layer and unsupported panel as well as between the fabric layer and the attached plate.

In some embodiments, the high temperature damper can be used in applications in which aero-acoustic vibration causes panels to be excited. Prior damping technologies utilize visco-elastic material such as rubber adhered to the back of a metallic or fiber-reinforced panel and therefore may only withstand temperatures as high as about 250 degrees Fahrenheit. The present disclosure uses a high temperature fabric, such as NEXTEL™, which allows the frictional component to withstand significantly higher temperatures and last longer than other viscoelastic dampers.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. An exhaust assembly for use with a gas turbine engine, the exhaust assembly comprising an exhaust duct configured for fluid communication with the gas turbine engine to receive hot exhaust gases produced by the gas turbine engine, the exhaust duct including a plurality of panels that define an exhaust passageway, a first panel included in the plurality of panels includes a flat inner surface that faces toward the exhaust passageway, a flat outer surface opposite the flat inner surface, and an outer edge that extends around the first panel, and the first panel being supported only along the outer edge, and a damper system configured to dampen vibration of the exhaust duct during use of the gas turbine engine, the damper system including a fabric damper sheet, a rigid damper plate, and a damper bracket, the fabric damper sheet engaged with the flat outer surface of the first panel, the rigid damper plate arranged in face-to-face relation with the fabric damper sheet and spaced apart from the first panel to locate the fabric damper sheet between the damper plate and the first panel, the damper plate having a body and a perimeter edge arranged around the body, and the damper bracket has a frame that extends along the perimeter edge of the damper plate and defines a window that opens through the damper bracket to expose the body of the damper plate, wherein the damper bracket is coupled with the first panel and engaged with the perimeter edge of the damper plate to change a resonance frequency of the exhaust duct and dampen the vibration of the exhaust duct during use of the gas turbine engine.

2. The exhaust assembly of claim 1, wherein the damper plate is coupled to the damper bracket by friction only.

3. The exhaust assembly of claim 1, wherein the fabric damper sheet comprises non-viscoelastic material.

4. The exhaust assembly of claim 1, wherein the frame of the damper bracket includes an attachment segment with an inner surface coupled to the first panel and a clip segment with an inner surface engaged with the damper plate, and the clip segment is offset from the attachment segment and arranged generally parallel with the attachment segment.

5. The exhaust assembly of claim 4, wherein clip segment is spaced apart from the damper plate to define a damper cavity between the clip segment and the first panel and a distance from the inner surface of the clip segment to the first panel is less than a cumulative thickness of the damper plate and the fabric damper sheet.

6. The exhaust assembly of claim 4, wherein the frame further includes a link that extends outwardly away from the first panel at an angle relative to the first panel to interconnect the attachment segment and the clip segment.

7. The exhaust assembly of claim 1, wherein the frame of the damper bracket includes an attachment segment with an inner surface coupled to the first panel, a clip segment with an inner surface engaged with the damper plate, and a link that extends outwardly away from the first panel at an angle relative to the first panel to interconnect the attachment segment to the clip segment, and the clip segment extends downwardly from the link at an angle toward the damper plate and is configured to apply a compressive force on the damper plate when the frame is fully installed on the first panel.

8. The exhaust assembly of claim 1, wherein the damper bracket further includes a cross member that extends across the window of the frame to divide the window into a first aperture and a second aperture.

9. The exhaust assembly of claim 8, wherein the damper bracket further includes a stiffening rib coupled with the cross member to reinforce the cross member and the frame.

10. An exhaust assembly for use with a gas turbine engine, the exhaust assembly comprising an exhaust duct including a plurality of panels that defines an exhaust passageway, a first panel included in the plurality of panels includes a flat inner surface that faces toward the exhaust passageway and a flat outer surface opposite the flat inner surface, and a damper system that includes a damper, a damper plate, and a damper bracket, the damper coupled with the flat outer surface of the first panel, the damper plate arranged in face-to-face relation with the damper and spaced apart from the first panel to locate the damper between the damper plate and the first panel, the damper plate having a body and a perimeter edge arranged around the body, and the damper bracket is coupled with the first panel and engaged with the damper plate to change a resonance frequency of the exhaust duct and dampen the vibration of the exhaust duct during use of the gas turbine engine, wherein the damper bracket includes a frame that extends along a perimeter edge of the damper plate and defines a window that opens through the damper bracket to expose the body of the damper plate, and the frame is coupled with the first panel and engaged with the perimeter edge of the damper plate to change a resonance frequency of the exhaust duct.

11. The exhaust assembly of claim 10, wherein the damper includes a fabric damper sheet made from non-viscoelastic material positioned between the damper plate and the first panel.

12. The exhaust assembly of claim 10, wherein an air gap is defined between the damper plate and the first panel to provide the damper.

13. The exhaust assembly of claim 10, wherein the damper bracket further includes a cross member that extends across the window of the frame to divide the window into a first aperture and a second aperture.

14. The exhaust assembly of claim 13, wherein the damper bracket further comprises a stiffening rib coupled with the cross member to reinforce the cross member and the frame.

15. The exhaust assembly of claim 10, wherein the damper bracket includes a plurality of washers coupled with an outer surface of the damper plate and a plurality of fasteners that extend through apertures formed in the damper plate and the first panel, the plurality of washers configured to clamp the damper plate and the damper between the plurality of washers and the first panel.

16. A method comprising providing an exhaust duct formed from a plurality of panels with inner surfaces defining an exhaust passageway and outer surfaces facing away from the exhaust passageway, discharging exhaust gases through the exhaust passageway to cause at least one of the panels to vibrate and produce noise and to expose the at least one panel to temperatures greater than about 250 degrees Fahrenheit, and changing a resonance frequency of the at least one panel by coupling a fabric damper sheet to the outer surface of the at least one panel to reduce vibrations and noise, wherein the step of changing the resonance frequency of the at least one panel includes applying a rigid damper plate over the fabric damper sheet to locate the fabric damper sheet between the damper plate and the at least one panel, and wherein the step of changing a resonance frequency of the at least one panel further includes clamping the damper plate and the fabric damper sheet to the at least one panel with a damper bracket that has a frame disposed around a perimeter of the damper plate and defines a window that opens to expose the damper plate.

17. The method of claim 16, wherein the step of changing a resonance frequency of the at least one panel further includes clamping the damper plate and the fabric damper sheet to the at least one panel with a plurality of washers and corresponding fasteners, the plurality of washers disposed along an outer surface of the damper plate.

* * * * *